United States Patent [19]

Werdecker et al.

[11] Patent Number: 4,564,433

[45] Date of Patent: Jan. 14, 1986

[54] BIPOLAR ELECTRODE

[75] Inventors: Waltraud Werdecker, Hanau; Peter Fabian, Freigericht, both of Fed. Rep. of Germany

[73] Assignee: Heraeus Elektroden GmbH, Hanau, Fed. Rep. of Germany

[21] Appl. No.: 626,860

[22] PCT Filed: Oct. 8, 1983

[86] PCT No.: PCT/EP83/00265

§ 371 Date: Jun. 21, 1984

§ 102(e) Date: Jun. 21, 1984

[87] PCT Pub. No.: WO84/01789

PCT Pub. Date: May 10, 1984

[30] Foreign Application Priority Data

Oct. 26, 1982 [DE] Fed. Rep. of Germany ..... 3239535

[51] Int. Cl.[4] ..... C25B 9/00

[52] U.S. Cl. ..... 204/254; 204/255; 204/256; 204/268; 204/292; 204/293

[58] Field of Search ..... 204/254, 255, 256, 268, 204/286, 292, 293

[56] References Cited

U.S. PATENT DOCUMENTS

| | | | |
|---|---|---|---|
| 4,017,375 | 4/1977 | Pohto | 204/255 |
| 4,059,216 | 11/1977 | Meyer | 204/256 |
| 4,108,756 | 8/1978 | de Nora | 204/286 |
| 4,402,809 | 9/1983 | Dilmore | 204/256 |

*Primary Examiner*—John F. Niebling

*Attorney, Agent, or Firm*—Frishauf, Holtz, Goodman & Woodward

[57] ABSTRACT

A bipolar electrode has plate-like anode and cathode parts. The anode and cathode parts are secured together, edge-to-edge, to form a single element in one plane by an intermediate connecting piece. The intermediate connecting piece itself is a composite element having parts of materials which are compatible with the respectively adjacent anode and cathode. The two parts of the composite element are joined together by hot isostatic pressure, explosion-plating or diffusion-welding into the composite body, the resultant composite body then permitting welding of the respective anode and cathode plates to the respective anode part and cathode part of the composite element or body.

11 Claims, 2 Drawing Figures

BIPOLAR ELECTRODE

The present invention relates to a bipolar electrode, and more particularly to such an electrode for use in electrochemical processes, especially for cells utilized in chlorate electrolysis.

BACKGROUND

Electrolysis cells, according to the prior art, have usually been made in one of two ways:

(a) The anode part and the cathode part both comprise the same material, and the anode part has an electrocatalytically active coating, or both parts comprise alloys having the same main components (see examined German Patent Application No. DE-AS 24 35 185, for instance); and (b) the anode and the cathode are located parallel to and at a distance from one another and are joined to one another via back plates made of two-layered metal strips (see German Patent Disclosure Document No. DE-OS 26 56 110).

Conventional joining methods for bipolar electrodes which are located parallel to each other and spaced from each other can be used.

Anode materials for bipolar electrodes usually use valve metals. They are used, conventionally, because they are dimensionally stable. The typical anode materials are titanium, tantalum, zirconium, niobium, tungsten. The foundation body of the anode material has an electrically conductive surface, for example a platinum metal, and platinum metal oxide, or a conductive metal oxide or oxide mixture resistant to the anolyte. Valve metals are metals which form non-conductive oxides which are resistant to the anolyte. The electrodes may be made in the form of expanded metal, net or grid. Expanded metal, net or grid anodes are preferred because of the larger electrocatalytically active surface and the desirable electrolyte flow which then can be attained.

The material for the cathode is selected from an electrically conductive substance which is resistant to the catholyte, usually steel, nickel, iron, or alloys of steel, nickel or iron. The cathode, like the anode, is preferably made of perforated material, and may be made from flat sheet or plates. The cathode, desirably, is coated on its surface with nickel or a nickel alloy or a nickel compound.

Joining non-compatible materials, such as tantalum for an anode and steel for a cathode, or titanium for an anode and steel for a cathode, causes difficulty. These metals cannot normally be welded to one another. In order to provide a connection between such non-compatible materials, an intermediate element was inserted therebetween made of a material which could be joined satisfactorily to both the anode material as well as the cathode material. A typical material used as a intermediate is copper. Copper, however, has a substantial disadvantage. Copper has no resistance to corrosion and, specifically, has no resistance to the electrolyte which is present in the environment in which the electrode is to operate.

It has been proposed to fabricate a bimetal element from two materials which normally cannot be welded together by roll-bonding or plate-bonding. An intermediate element used to connect the cathode and the anode which is made of roll-bonded bimetal cannot be used in electrodes, however, since the roll bond does not withstand the welding conditions of the respective metal of the intermediate element to the anode or cathode, respectively. The high temperatures required during welding, particularly for welding of tantalum for example, would destroy the bond and/or the intermediate bonding material.

THE INVENTION

It is an object to provide a bipolar electrode which is flat, that is, is essentially of plate-like construction both in the anode as well as in the cathode part, and in which the flat electrode is made of two entirely different materials, which are not normally capable of being joined or welded together.

Briefly, an anode electrode of plate-like form and a cathode electrode of plate-like form are joined together at their edges, that is, in one plane, by an intermediate joining element or joining piece. The intermediate joining piece is a composite element which consists of a material compatible, for example by welding, with the anode, and another material compatible, for example by welding, with the cathode. The two materials of the intermediate piece are joined into the one single composite element by hot isostatic pressure, explosion-plating, or diffusion-welding.

The bipolar electrode, in which the anode portion and the cathode portion are joined by the composite element, has the advantage of ease of manufacture, low potential, in particular hydrogen overload, the avoidance of hydride formation on a cathode, which is particularly important in chlorate cells.

The invention permits use of materials for the anode and the cathode which normally cannot be welded or joined together. Such materials, however, have the most desirable electrochemical properties for the anode and the cathode, respectively. The conditions of operation for a particular electrochemical process in which the electrode is to be used can also be optimized by selecting the materials for the anode and cathode, respectively, regardless of their compatibility to be joined together. The intermediate piece or connecting strip, joining the plate-like electrode elements edge-to-edge, in accordance with the invention, permits such selection independent of physical joining characteristics of the respective material.

DRAWING

Shown are

FIG. 1, a plan view of the assembled bipolar electrode; and

FIG. 2, a longitudinal section through the electrode of FIG. 1.

DETAILED DESCRIPTION

Figure 1:
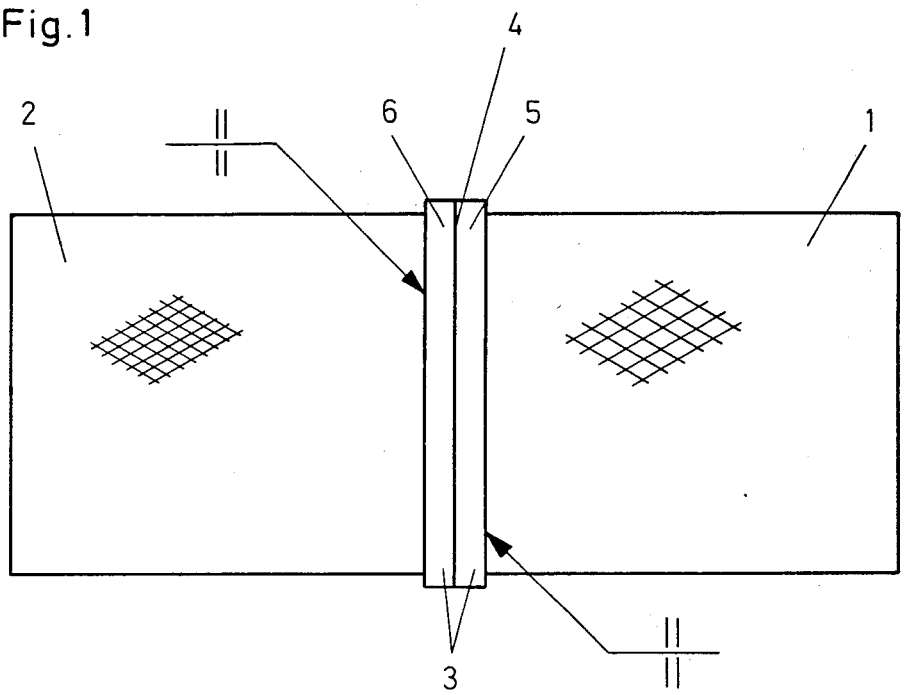
Figure 2:
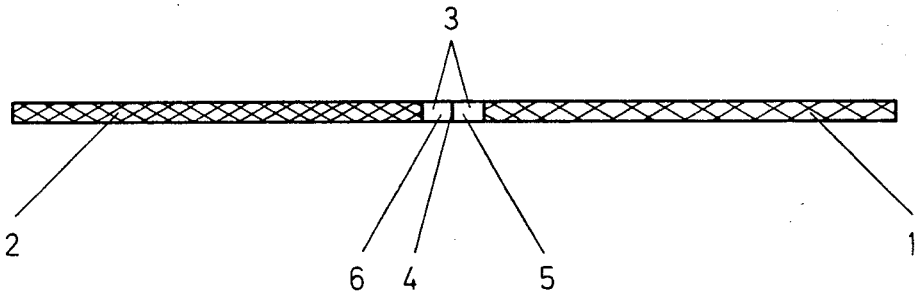

The bipolar electrode has an anode part 1 and a cathode part 2. The two parts 1, 2 are joined together in one plane via an intermediate piece 3, as shown in the drawings. In its part 5 facng the anode, the intermediate piece 3 comprises anode material, and in its side 6 facing the cathode, it comprises cathode material. The two regions are separated by a boundary or abutting surface 4, visible from the outside only as a line, and the thickness of which substantially corresponds to that of the anode and cathode pieces 5, 6. The intermediate piece 3, is a composite body. It is disposed between the abutting locations on the narrow side of the anode part 1 and cathode part 2, which are facing each other, and is joined to the respective anode and cathode parts 1, 2 by welding. Conventional fusion welding processes, namely resistance and spot welding, TIG or NIG welding, welding using laser beams and the like, are preferred.

PREFERRED REALIZATION OF THE INVENTION

According to a preferred feature of the invention intermediate pieces are manufactured from a composite body, one half each being of anode and cathode material, for example, and abutting flush over the width and thickness of the subsubstantially plate-like electrode. The composite bodies are substantially shaped in strips prior to being bonded to the electrode parts and are approximately the same width as the electrode. They are manufactured as follows, by way of example:

One titanium and one steel sheet were welded in a chamber in an argon atmosphere, advantageously in a capsule of the same steel, the one side of the steel capsule already having the desired thickness of the steel portion of the bonding piece, after the sheets had been pre-cleaned, in particular pickled and/or degreased. The capsule was isostatically hot pressed at a pressure between 800 and 2000 bar and at a temperature in the range between approximately 780° and 820° C. and kept under pressure and heat for a period of approximately 30 to 180 minutes and in particular 60 to 120 minutes, with a preceding heating and subsequent cooling period. The composite body made in this way was subsequently released from the capsule, for example by mechanical or chemical removal. The pressed body may then be cut apart into the final form, e.g. into small strips, as needed.

What is of the essence is that the composite body made in this way has an intermetallic phase bond with a satisfactorily fine granularity of the materials and a particularly high density, that is, without flaws such as hairline cracks and the like. It is thereby possible to attain a good flow of electric current and thus low potential losses as well.

The hot isostatic pressing method was performed in a known manner in a plant of the W. C. Heraeus GmbH firm in Hanau. Instead of the hot isostatic pressing method, an intermetallic bond can also be produced between the two materials, which cannot normally be welded, by explosion plating or by a conventional diffusion welding process; however, the hot isostatic pressing method is preferred.

Naturally, composite electrodes of the bipolar type can also be fabricated from a number of anode and cathode parts assembled in pairs with intermediate pieces for forming a one-piece, flat, in particular plate-like electrode. The configuration of the electrode is dependent only on the size of the cell and the arrangement in it, as well as on the desired electrolyte flow and the electrical input and output lines.

USE OF ELECTRODES

The bipolar electrodes according to the invention can be used in electrochemical cells; they are particularly well suited for the electrolysis of aqueous solutions of alkali chlorides. A bipolar electrode is not connected directly to the current supply; instead, one surface acts as an anode and the other surface as a cathode when the current flows through the cell. Clamps which connect those parts of the electrode which have the same polarity are suitable for supplying the current. The novel bipolar electrodes can advantageously be arranged in the cell in such a way (horizontally or vertically) that one cathode area is always opposite one anode area.

The flow direction of the electrolyte can be between the plate-like electrodes and through them, that is, along their plane, or through the perforation of the electrodes. A circulation of electrolyte takes place as needed between the inlet and the outlet of the cell.

Further modifications of the exemplary embodiments can be made without departing from the scope of the invention.

We claim:

1. Bipolar electrode in flat, particularly plate form, especially for use in electrochemical processes such as chlorate electrolysis, consisting of three elements, namely a plate-like anode (1);

a plate-like cathode (2), the cathode and anode, each consisting of metal which cannot be welded together; and an intermediate piece (3) joining the anode and cathode edge-to-edge, wherein the intermediate piece consists of a two-part (5, 6) composite element (3) having a first anode part (5) consisting of the material of the anode and a second cathode part (6) consisting of the material of the cathode, said first anode part and said second cathode part being joined together by an intermetallic phase bond of materials formed by at least one of:

hot isostatic pressure;

explosion-plating;

diffusion-welding, of said first anode part and said second cathode part into said composite element;

the anode part (5) of the intermediate composite element (3) of the composite intermediate piece (3) and the cathode part (6) of the composite intermediate piece being joined, respectively, to the anode (1) and the cathode (2) by welding to facing side edges of the anode and cathode, respectively, whereby the bipolar electrode will be located essentially in a single plane with the intermediate piece (3) between the anode and the cathode in essentially said plane.

2. Electrode according to claim 1, wherein the anode and cathode, each, comprise flat sheets which are perforated.

3. Electrode according to claim 1, wherein the anode and cathode, respectively, comprise flat sheets which are embossed with elevations and depressions in the form of grids, nets, or expanded metal.

4. Electrode according to claim 1, in combination with an electrolysis cell for chlorine-alkali electrolysis, wherein the electrodes are perforated, and electrolyte is directed to flow through the electrode, gas being generated during the circulation of electrolyte in the cell.

5. Electrode according to claim 2, for use in an electrolysis cell for chlorine-alkali electrolysis having electrodes experiencing the flow through them of electrolyte and generating gas during the circulation of electrolyte in the cell.

6. Electrode according to claim 3, for use in an electrolysis cell for chlorine-alkali electrolysis having electrodes experiencing the flow through them of electrolyte and generating gas during the circulation of electrolyte in the cell.

7. Electrode according to claim 1, wherein the dimension of the intermediate composite piece, in the direction of the thickness of the anode and cathode, respectively corresponds essentially to the thickness of:one of the anode, the cathode.

8. Electrode according to claim 1, wherein the anode and cathode are of essentially the same thickness; and the dimension of the intermediate composite piece, in the direction of the thickness of the anode and cathode, respectively corresponds essentially to the thickness of the anode and the cathode to thereby form, with the anode and cathode, an essentially flat plate or sheet.

9. Electrode according to claim 1, wherein the anode part consists of one of the metals of the group consisting of:titanium, tantalum, zirconium, niobium, tungsten and the cathode part consists of one of the materials of the group consisting of: steel, nickel, iron, or alloys of steel, nickel and iron.

10. Electrode according to claim 7, wherein the anode part consists of titanium and the cathode part consists of steel.

11. Electrode according to claim 1, wherein said first anode part (5) and second cathode part (6) of the intermediate composite piece (3) are bonded together by hot-isostatic pressure to form said intermetallic phase bond.

* * * * *